US011319956B2

(12) United States Patent
Bron et al.

(10) Patent No.: US 11,319,956 B2
(45) Date of Patent: May 3, 2022

(54) SCROLL COMPRESSOR PROVIDED WITH AN ORBITAL DISC LUBRICATION SYSTEM

(71) Applicant: Danfoss Commercial Compressors, Trevoux (FR)

(72) Inventors: Mickael Bron, Nordborg (DK); Rémi Bou Dargham, Villeurbanne (FR); Yusong Sun, Nordborg (DK)

(73) Assignee: Danfoss Commercial Compressors, Trevoux (FR)

( * ) Notice: Subject to any disclaimer, the term of this patent is extended or adjusted under 35 U.S.C. 154(b) by 125 days.

(21) Appl. No.: 16/911,565

(22) Filed: Jun. 25, 2020

(65) Prior Publication Data

US 2020/0408208 A1 Dec. 31, 2020

(30) Foreign Application Priority Data

Jun. 28, 2019 (CN) ..... 201910582863.7

(51) Int. Cl.
*F04C 18/02* (2006.01)
*F04C 29/02* (2006.01)

(52) U.S. Cl.
CPC ..... *F04C 18/0215* (2013.01); *F04C 29/025* (2013.01); *F04C 2240/50* (2013.01); *F04C 2240/809* (2013.01)

(58) Field of Classification Search
CPC .... F04C 18/0215; F04C 29/025; F04C 29/02; F04C 23/008; F04C 2240/50; F04C 2240/809; F04C 2240/807; F01C 17/063
See application file for complete search history.

(56) References Cited

U.S. PATENT DOCUMENTS 4,522,575 A * 6/1985 Tischer ..... F04C 23/008 418/55.5
5,037,278 A * 8/1991 Fujio ..... F04C 23/008 418/55.2

(Continued)

FOREIGN PATENT DOCUMENTS

CN 108361193 A 8/2018
EP 2 229 535 A2 9/2010

(Continued)

OTHER PUBLICATIONS

First Examination Report for Indian Patent Application No. 202014017674 dated Mar. 3, 2021.

(Continued)

*Primary Examiner* — Audrey B. Walter
*Assistant Examiner* — Dapinder Singh
(74) *Attorney, Agent, or Firm* — McCormick, Paulding & Huber PLLC

(57) ABSTRACT

The scroll compressor includes a fixed scroll; an orbiting scroll (8); a drive shaft (16); a support arrangement (5) on which is slidably mounted the orbiting scroll (8); a rotation preventing device configured to prevent rotation of the orbiting scroll (8) with respect to the fixed scroll, the rotation preventing device including orbital discs (28) respectively arranged in circular receiving holes (29) provided on the support arrangement (5), each orbital disc (28) being provided with an outer circumferential bearing surface (31) configured to cooperate with an inner circumferential bearing surface (32) provided on the respective circular receiving hole (29); and a lubrication system configured to lubricate the inner and outer circumferential bearing surfaces (32, 31) with oil supplied from an oil sump, the lubrication system including an oil reservoir (38) in which part of the oil supplied to the lubrication system is collected during operation of the scroll compressor, and a plurality of lubrication (Continued)

passages (41) provided on the support arrangement (5), each lubrication passage (41) including an oil outlet aperture (41.2) emerging in a bottom surface of a respective circular receiving hole (29) and an oil inlet aperture (41.1) emerging in the receiving chamber (27).

20 Claims, 3 Drawing Sheets

(56) References Cited

U.S. PATENT DOCUMENTS

| | | | | |
|---|---|---|---|---|
| 8,444,403 | B2 * | 5/2013 | Tang | F04C 27/005 418/55.4 |
| 10,704,548 | B2 * | 7/2020 | Choi | F04C 23/008 |
| 2018/0216616 | A1 | 8/2018 | Daussin et al. | |
| 2019/0345942 | A1 * | 11/2019 | Park | F01C 17/066 |

FOREIGN PATENT DOCUMENTS

| | | | |
|---|---|---|---|
| JP | S58-30402 | A | 2/1983 |
| JP | H09317663 | A | 12/1997 |
| JP | 2004-27983 | A | 1/2004 |
| JP | 2005-201171 | A | 7/2005 |
| JP | 4427354 | B2 | 3/2010 |
| KR | 20000000870 | A | 1/2000 |

OTHER PUBLICATIONS

English Translation of Office Action to corresponding Chinese Application No. 201910582863.7.

* cited by examiner

SCROLL COMPRESSOR PROVIDED WITH AN ORBITAL DISC LUBRICATION SYSTEM

CROSS-REFERENCE TO RELATED APPLICATION

This application claims foreign priority benefits under 35 U.S.C. § 119 to Chinese Patent Application No. 201910582863.7 filed on Jun. 28, 2019, the content of which is hereby incorporated by reference in its entirety.

TECHNICAL FIELD

The present invention relates to a scroll compressor, and in particular to a scroll refrigeration compressor.

BACKGROUND

JP4427354 discloses a scroll compressor including:

a fixed scroll comprising a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft including a driving portion configured to drive the orbiting scroll in an orbital movement, the drive shaft being rotatable around a rotation axis, a support frame including a thrust bearing surface on which is slidably mounted the orbiting scroll, a rotation preventing device configured to prevent rotation of the orbiting scroll with respect to the fixed scroll and the support arrangement, the rotation preventing device including:

a plurality of orbital discs respectively arranged in circular receiving holes provided on the support arrangement, each orbital disc being provided with an eccentric hole and with an outer circumferential bearing surface configured to cooperate with an inner circumferential bearing surface provided on the respective circular receiving hole, and a plurality of pins each including a first end portion secured to the orbiting base plate and a second end portion rotatably mounted in the eccentric hole of a respective orbital disc, an oil sump, and a lubrication system configured to lubricate at least partially the inner and outer circumferential bearing surfaces with oil supplied from the oil sump.

Particularly, the lubrication system of JP4427354 includes a plurality of lubrication grooves formed in the thrust bearing surface, each lubrication grooves including a first end emerging in an inner surface of the support frame and a second end emerging in the inner circumferential bearing surface of a respective circular receiving hole and at a position where high load occurs during rotation of the drive shaft around its rotation axis.

Such a provision of the lubrication grooves in the thrust bearing surface decreases the surface area of the thrust bearing surface, which may harm the reliability of the scroll compressor.

Further such a location of the second end of each lubrication groove does not ensure a proper lubrication of the outer circumferential bearing surfaces of the orbital discs, especially for scroll compressors having large capacity, since the high loads applied on the orbital discs during rotation of the drive shaft avoids or at least limits the oil supply between the outer circumferential bearing surfaces and the inner circumferential bearing surfaces of the rotation preventing device.

US2018/0216616 discloses a lubrication system including lubrication passages formed within the support arrangement and each including an oil outlet aperture emerging in the inner circumferential bearing surface of a respective circular receiving hole and at a predetermined position where low load occurs during rotation of the drive shaft around its rotation axis. However, such a configuration of the lubrication system may not ensure sufficient oil delivery to the circular receiving holes particularly at compressor start, and is complex to manufacture.

Consequently, the configuration of the lubrication systems of the scroll compressors previously disclosed does not ensure, especially for high capacity scroll compressors, an optimized oil supply to the rotation preventing device, which may harm the reliability and lifetime of the scroll compressor. Further, the lubrication systems of the scroll compressors previously disclosed are complex to manufacture.

SUMMARY

It is an object of the present invention to provide an improved scroll compressor which can overcome the drawbacks encountered in conventional scroll compressors.

Another object of the present invention is to provide a scroll compressor which has an improved reliability and lifetime compared to the conventional scroll compressors, and which is easier to manufacture.

According to the invention such a scroll compressor includes:

a fixed scroll comprising a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft including a driving portion configured to drive the orbiting scroll in an orbital movement, the drive shaft being rotatable around a rotation axis, a support arrangement including a thrust bearing surface on which is slidably mounted the orbiting scroll, the support arrangement and the orbiting scroll forming a receiving chamber in which the driving portion of the drive shaft is movably disposed, a rotation preventing device configured to prevent rotation of the orbiting scroll with respect to the fixed scroll and the support arrangement, the rotation preventing device including:

a plurality of orbital discs respectively arranged in circular receiving holes provided on the support arrangement, each orbital disc being provided with an eccentric hole and with an outer circumferential bearing surface configured to cooperate with an inner circumferential bearing surface provided on the respective circular receiving hole, and a plurality of pins each including a first end portion secured to the orbiting base plate and a second end portion rotatably mounted in the eccentric hole of a respective orbital disc, an oil sump, and a lubrication system configured to lubricate at least partially the inner and outer circumferential bearing surfaces with oil supplied from the oil sump, the lubrication system including an oil reservoir which is defined by the receiving chamber, and for example by a lower part of the receiving chamber, and in which part of the oil supplied to the lubrication system is collected and stored during operation of the scroll compressor, the lubrication system further including a plurality of lubrication passages provided on the support arrangement and fluidly connected to the receiving chamber, each lubrication passage including an oil outlet aperture emerging in a bottom surface of a respective circular receiving hole and an oil inlet aperture emerging in the receiving chamber.

Such a configuration of the lubrication system, and particularly such a location of the oil outlet aperture of each lubrication passage, ensures that an important amount of oil, supplied from the oil reservoir, reaches the bottom surface of each of the circular receiving holes and thus ensures a proper lubrication of the outer circumferential bearing surfaces of the orbital discs by centrifugal effect. In addition, as there always is kept a minimum amount of oil in the oil reservoir after compressor stop, the lubrication system is able to supply the circular receiving holes with oil right after compressor start, without waiting for oil supplied from the oil sump of the scroll compressor. Consequently, such a configuration of the lubrication system imparts to the scroll compressor an improved reliability and lifetime, while simplifying the manufacture of the scroll compressor.

Further, since the lubrication passage are not formed in the thrust bearing surface, the surface area of the latter is not decreased, which also improves the reliability of the scroll compressor.

The scroll compressor may also include one or more of the following features, taken alone or in combination.

According to an embodiment of the invention, the lubrication system further includes an oil supplying channel fluidly connected to the oil sump and extending over at least a part of the length of the drive shaft, the oil supplying channel being configured to supply the oil reservoir with oil from the oil sump.

According to an embodiment of the invention, the oil supplying channel emerges in an end face of the drive shaft oriented towards the orbiting scroll.

According to an embodiment of the invention, the orbiting scroll further includes a hub portion in which the driving portion of the drive shaft is at least partially mounted, the hub portion being movably disposed in the receiving chamber.

According to an embodiment of the invention, the scroll compressor further includes a counterweight connected to the driving portion and configured to at least partially balance the mass of the orbiting scroll, the counterweight being movably disposed in the receiving chamber and being configured to generate oil mist from oil contained in the oil reservoir and to splash oil towards inner walls of the receiving chamber and towards the lubrication passages notably by centrifugation. As a minimum amount of oil is always kept in the oil reservoir after compressor stop, the counterweight will be able to supply oil towards the lubrication passages right after the compressor start, without waiting for oil supplied from oil sump. Therefore such arrangement of the counterweight with respect to the receiving chamber further improves the lubrication of the outer circumferential bearing surfaces of the orbital discs, and thus the reliability and lifetime of the scroll compressor.

According to an embodiment of the invention, the shape of the counterweight and the inner wall surface of the receiving chamber are adapted to spread and guide as much oil as possible towards the lubrication passages.

According to an embodiment of the invention, the lubrication system further includes at least one oil supplying passage at least partially defined by the counterweight, the at least one oil supplying passage being configured to supply the thrust bearing surface with oil.

According to an embodiment of the invention, the at least one oil supplying passage is configured to supply the oil reservoir with oil.

According to an embodiment of the invention, the counterweight includes a counterweight inner surface and a counterweight end surface respectively facing the hub portion and the orbiting base plate, the counterweight inner surface and the counterweight end surface at least partially defining the at least one oil supplying passage.

According to an embodiment of the invention, the counterweight includes at least one oil supplying groove or bore provided on the counterweight inner surface and the counterweight end surface and defining the at least one oil supplying passage.

According to an embodiment of the invention, the counterweight inner surface and the counterweight end surface are respectively substantially complementary to respective contours of the hub portion and the orbiting base plate.

According to an embodiment of the invention, the at least one oil supplying passage is fluidly connected to the oil supplying channel.

According to an embodiment of the invention, the lubrication system includes an oil feeding passage provided on, and for example formed within, the driving portion of the drive shaft and fluidly connected to the oil supplying channel, the oil feeding passage being configured to supply the at least one supplying passage with oil.

According to an embodiment of the invention, the oil feeding passage includes a first end emerging in the end face of the drive shaft oriented towards the orbiting scroll and a second end emerging in an outer wall of the driving portion of the drive shaft facing the counterweight.

According to an embodiment of the invention, each lubrication passage extends substantially parallely to the rotation axis of the drive shaft.

According to an embodiment of the invention, the oil inlet aperture of each lubrication passage emerges in an inner surface of the support arrangement.

According to an embodiment of the invention, the lubrication system further includes an oil return passage provided on the support arrangement, the oil return passage including an oil inlet port emerging in the receiving chamber, and an oil outlet port fluidly connected to the oil sump and configured to return a part of the oil contained in the oil reservoir towards the oil sump. The provision of the oil return passage ensures an oil circulation after lubricating the rotation preventing device.

According to an embodiment of the invention, the oil outlet port is axially positioned so as to define a maximal oil level of the oil reservoir.

According to an embodiment of the invention, the oil outlet port is axially positioned such that a lower end of the counterweight is immersed into the oil reservoir.

According to an embodiment of the invention, the support arrangement includes a support frame including the thrust bearing surface.

According to an embodiment of the invention, the support arrangement further includes a main bearing configured to guide in rotation a guided portion of the drive shaft, the lubrication system being configured to lubricate at least partially the main bearing with oil supplied from the oil sump.

According to an embodiment of the invention, the lubrication system further includes a lubrication hole provided on the drive shaft and fluidly connected to the oil supplying channel, the lubrication hole emerging in an outer wall of the guided portion of the drive shaft and facing the main bearing.

According to an embodiment of the invention, each lubrication passage has a circular cross section.

According to an embodiment of the invention, each lubrication passage has a cross section which is higher than 25% of the cross section of the respective circular receiving hole.

According to an embodiment of the invention, each lubrication passage has a cross section which is higher than a cross section of the respective eccentric hole.

According to an embodiment of the invention, each circular receiving hole emerges in the thrust bearing surface.

According to an embodiment of the invention, the oil outlet aperture of each lubrication passage emerges in a central portion of the bottom surface of the respective circular receiving hole.

The present invention also relates to a method for lubricating a rotation preventing device of a scroll compressor, comprising:

- providing a scroll compressor according to the present invention,
- supplying oil to the oil reservoir defined by the receiving chamber, and delivering the oil to the lubrication passages with the help of the counterweight, and
- supplying oil to the thrust bearing surface via the at least one oil supplying passage which is at least partially defined by the counterweight.

These and other advantages will become apparent upon reading the following description in view of the drawings attached hereto representing, as non-limiting example, an embodiment of a scroll compressor according to the invention.

BRIEF DESCRIPTION OF THE DRAWINGS

The following detailed description of one embodiment of the invention is better understood when read in conjunction with the appended drawings being understood, however, that the invention is not limited to the specific embodiment disclosed.

DETAILED DESCRIPTION

Figure 1:
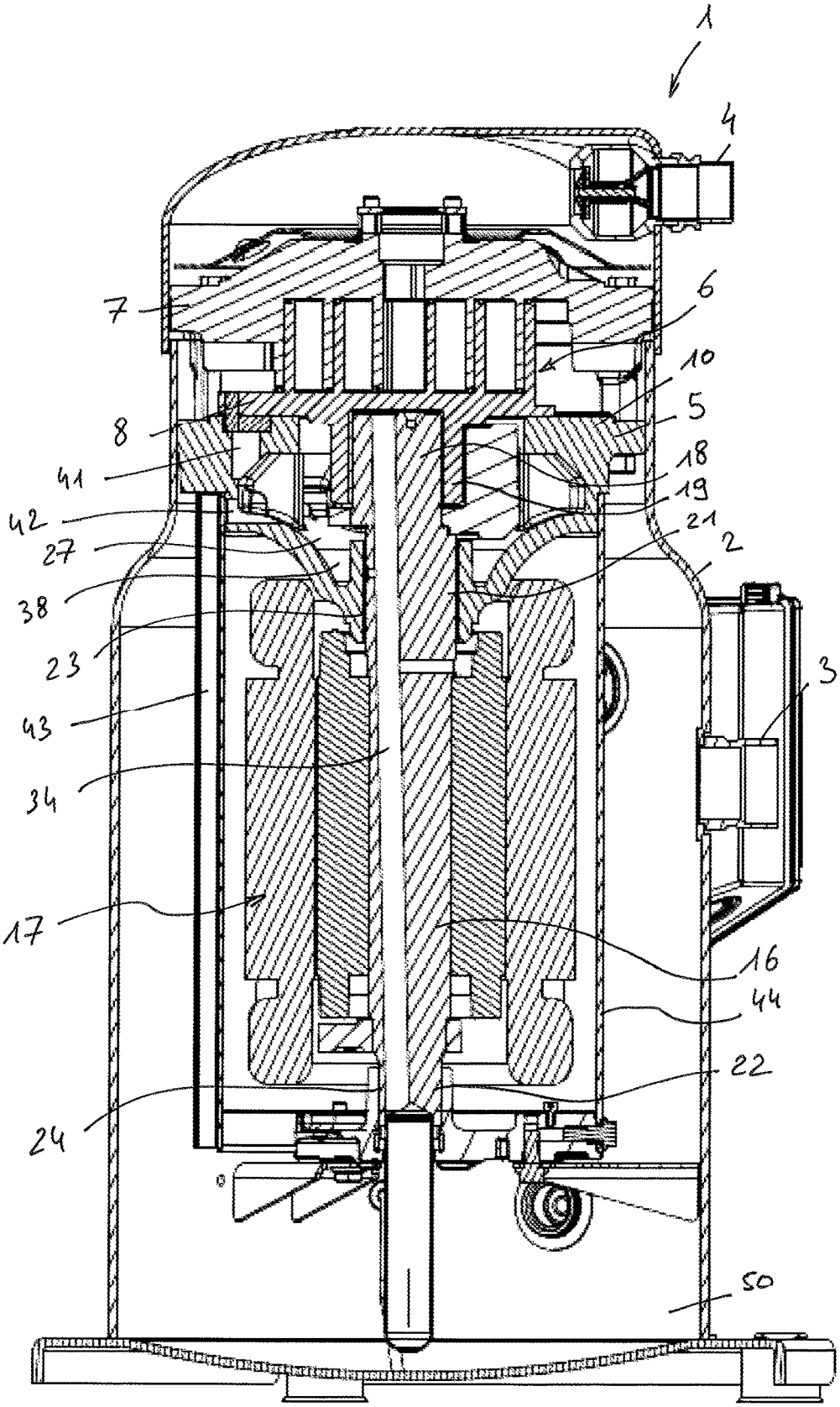
FIG. 1 is a longitudinal section view of a scroll compressor according to the invention.
Figure 2:
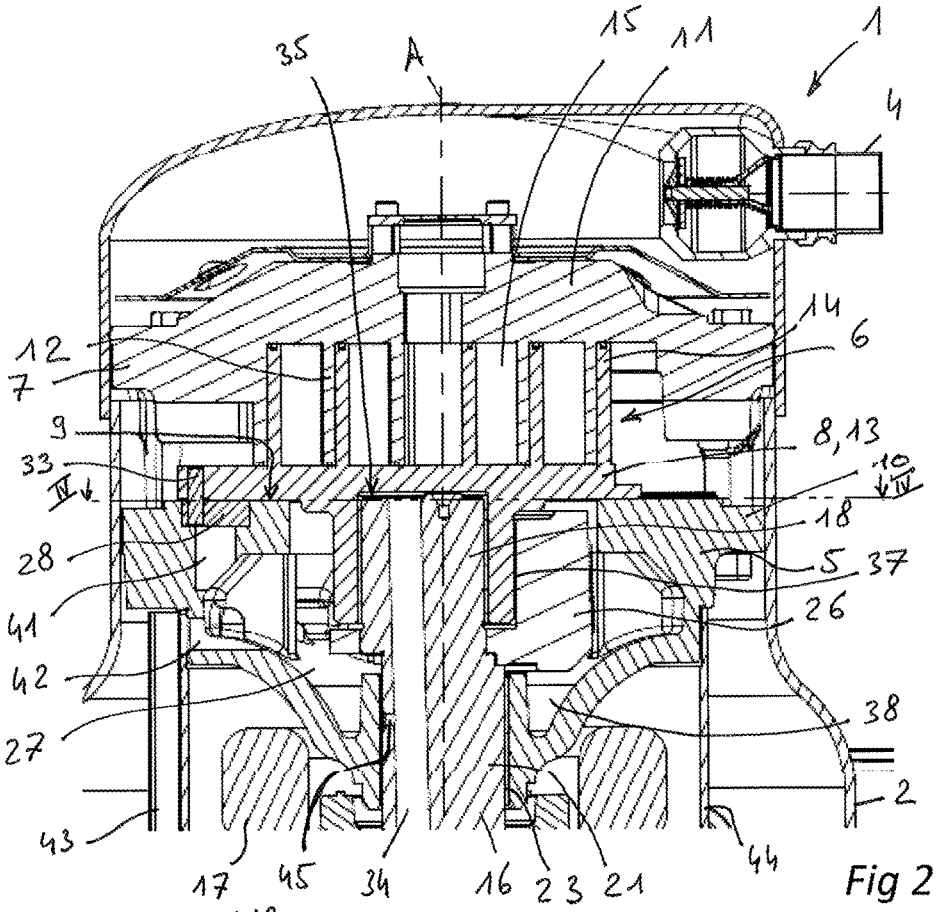
FIG. 2 is a partial longitudinal section view of the scroll compressor according to FIG. 1.
Figure 3:
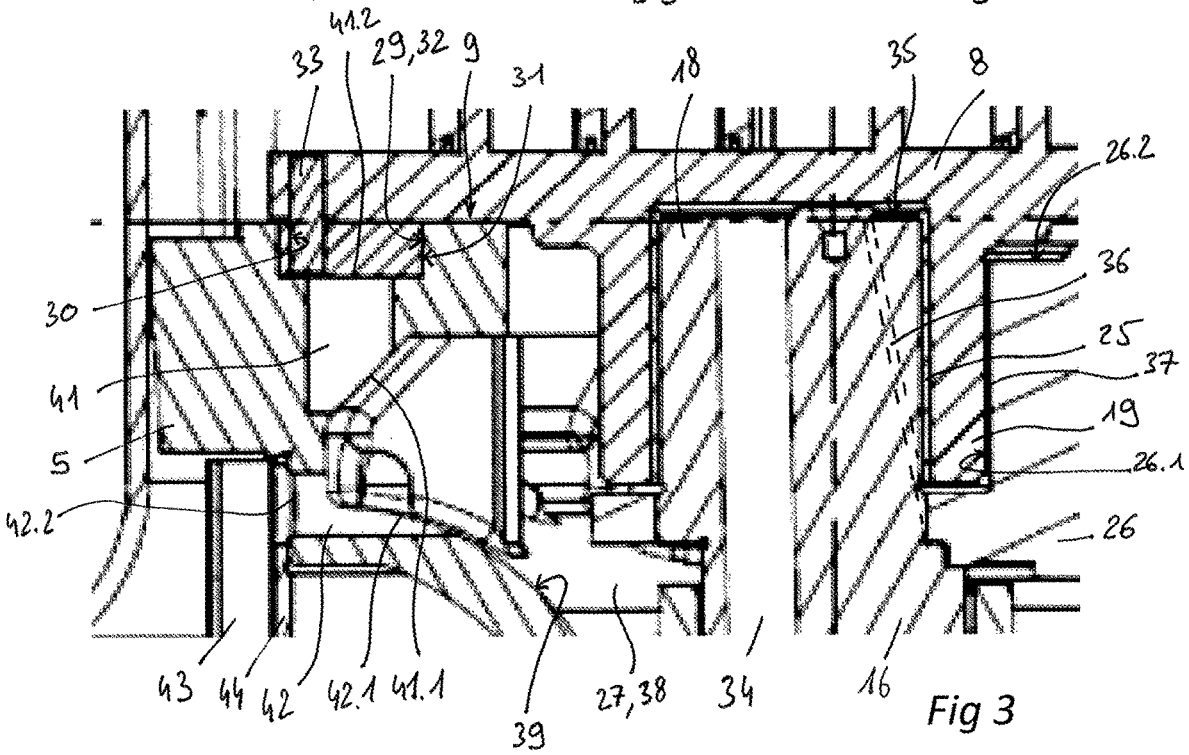
FIG. 3 is an enlarged view of a detail of FIG. 2.
Figure 4:
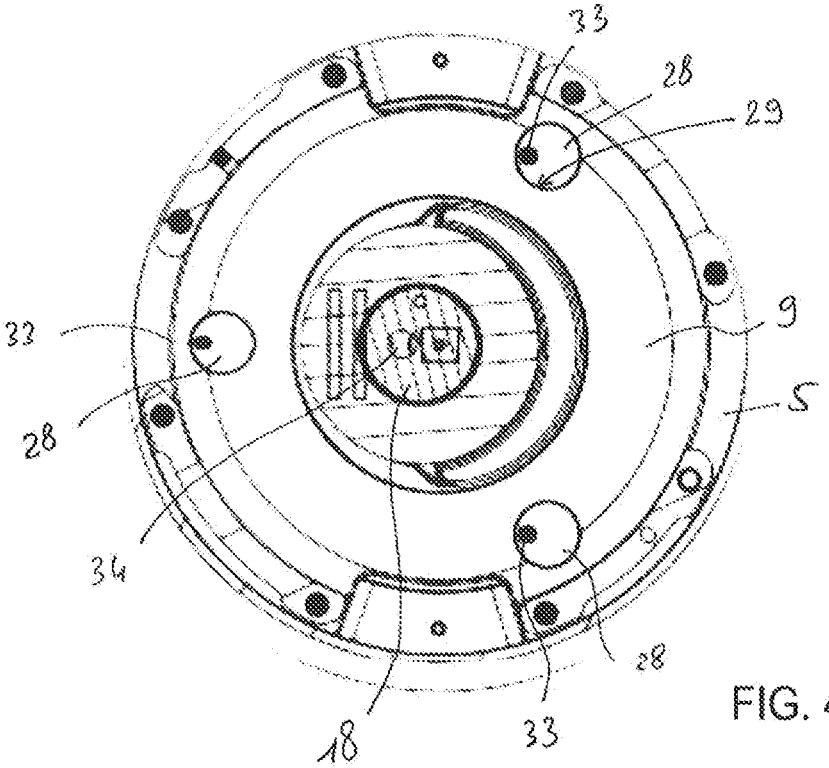
FIG. 4 is a transversal section view along line IV-IV of FIG. 2.

FIG. 1 describes a scroll compressor 1 according to an embodiment of the invention occupying a vertical position.

The scroll compressor 1 includes a hermetic casing 2 provided with a suction inlet 3 configured to supply the scroll compressor 1 with refrigerant to be compressed, and with a discharge outlet 4 configured to discharge compressed refrigerant.

The scroll compressor 1 further includes a support arrangement 5, also named crankcase, fixed to the hermetic casing 2, and a compression unit 6 disposed inside the hermetic casing 2 and supported by the support arrangement 5. The compression unit 6 is configured to compress the refrigerant supplied by the suction inlet 3. The compression unit 6 includes a fixed scroll 7, which is fixed in relation to the hermetic casing 2, and an orbiting scroll 8 supported by and in slidable contact with a thrust bearing surface 9 provided on the support arrangement 5. According to the embodiment shown on the drawings, the support arrangement 5 includes a one-piece support frame 10 including the thrust bearing surface 9.

The fixed scroll 7 includes a fixed base plate 11 having a lower face oriented towards the orbiting scroll 8, and an upper face opposite to the lower face of the fixed base plate 11. The fixed scroll 7 also includes a fixed spiral wrap 12 projecting from the lower face of the fixed base plate 11 towards the orbiting scroll 8.

The orbiting scroll 8 includes an orbiting base plate 13 having an upper face oriented towards the fixed scroll 7, and a lower face opposite to the upper face of the orbiting base plate 13 and slidably mounted on the thrust bearing surface 9. The orbiting scroll 8 also includes an orbiting spiral wrap 14 projecting from the upper face of the orbiting base plate 13 towards the fixed scroll 7. The orbiting spiral wrap 14 of the orbiting scroll 8 meshes with the fixed spiral wrap 12 of the fixed scroll 7 to form a plurality of compression chambers 15 between them. Each of the compression chambers 15 has a variable volume which decreases from the outside towards the inside, when the orbiting scroll 8 is driven to orbit relative to the fixed scroll 7.

Furthermore the scroll compressor 1 includes a drive shaft 16 configured to drive the orbiting scroll 8 in an orbital movement, and an electric driving motor 17, which may be a variable-speed electric driving motor, coupled to the drive shaft 16 and configured to drive in rotation the drive shaft 16 about a rotation axis A.

The drive shaft 16 includes, at its upper end, a driving portion 18 which is offset from the longitudinal axis of the drive shaft 16, and which is partially mounted in a hub portion 19 provided on the orbiting scroll 8. The driving portion 18 is configured to cooperate with the hub portion 19 so as to drive the orbiting scroll 8 in orbital movements relative to the fixed scroll 7 when the electric driving motor 17 is operated.

The drive shaft 16 also includes an upper guided portion 21 adjacent to the driving portion 18 and a lower guided portion 22 opposite to the first guided portion 21, and the scroll compressor 1 further includes an upper main bearing 23 provided on the support arrangement 5 and configured to guide in rotation the upper guided portion 21 of the drive shaft 16, and a lower main bearing 24 configured to guide in rotation the lower guided portion 22 of the drive shaft 16. The scroll compressor 1 also includes an orbiting scroll hub bearing 25 provided on the orbiting scroll 8 and arranged for cooperating with the driving portion 18 of the drive shaft 16.

Furthermore, the scroll compressor 1 includes a counterweight 26 secured to the driving portion 18 and configured to at least partially balance the mass of the orbiting scroll 8. Particularly, the support arrangement 5 and the orbiting scroll 8 form a receiving chamber 27 in which the hub portion 19, the driving portion 18 and the counterweight 26 are movably disposed.

The scroll compressor 1 also includes a rotation preventing device configured to prevent rotation of the orbiting scroll 8 with respect to the fixed scroll 7 and the support arrangement 5. Particularly, the rotation preventing device includes:

- a plurality of orbital discs 28 respectively arranged in circular receiving holes 29 which are provided on the support arrangement 5 and which emerge in the thrust bearing surface 9, each orbital disc 28 being provided with an eccentric hole 30 and with an outer circumferential bearing surface 31 configured to cooperate with an inner circumferential bearing surface 32 provided on the respective circular receiving hole 29, and a plurality of pins 33 each including a first end portion unrotatably secured to the orbiting base plate 13 and a second end portion rotatably mounted in and cooperating with the eccentric hole 30 of the respective orbital disc 28.

According to the embodiment shown on the figures, the rotation preventing device includes three orbital discs 28 and three pins 33, the orbital discs 28 being angularly offset, and particularly regularly angularly offset, with respect to the rotation axis A of the drive shaft 16.

The scroll compressor 1 further comprises a lubrication system configured to lubricate at least partially the inner and outer circumferential bearing surfaces 31, 32, the sliding surfaces between the orbital discs 28 and the bottom surfaces of the receiving holes 29, as well as the sliding surfaces between the eccentric holes 30 and the pins 33 with oil supplied from an oil sump 50 defined by the hermetic casing 2.

The lubrication system includes an oil supplying channel 34 formed within the drive shaft 16 and extending over the whole length of the drive shaft 16. The oil supplying channel 34 is configured to be supplied with oil from the oil sump 50. According to the embodiment shown on the figures, the oil supplying channel 34 emerges in an end face 35 of the drive shaft 16 oriented towards the orbiting scroll 8.

The lubrication system further includes an oil feeding passage 36 provided on the driving portion 18 of the drive shaft 16 and fluidly connected to the oil supplying channel 34. According to the embodiment shown on the figures, the oil feeding passage 36 includes a first end emerging in the end face 35 of the drive shaft 16 and a second end emerging in an outer wall of the driving portion 18 facing the counterweight 26 in the area of the lower end of hub portion 19.

The lubrication system also includes an oil supplying passage 37 defined by the counterweight 26 and fluidly connected to the oil feeding passage 36. According to the embodiment shown on the figures, the counterweight 26 includes a counterweight inner surface 26.1 and a counterweight end surface 26.2 respectively facing the hub portion 19 and the orbiting base plate 13, and the counterweight inner surface 26.1 and the counterweight end surface 26.2 define the oil supplying passage 37. For example, the counterweight 26 may include an oil supplying groove provided on the counterweight inner surface 26.1 and on the counterweight end surface 26.2 and defining the oil supplying passage. Advantageously, the counterweight inner surface 26.1 and the counterweight end surface 26.2 are respectively substantially complementary to respective contours of the hub portion 19 and the orbiting base plate 13.

The lubrication system also includes an oil reservoir 38 which is defined by a lower part of the receiving chamber 27 and in which part of the oil supplied to the oil supplying channel 34 is collected and stored during operation of the scroll compressor 1.

Furthermore, the lubrication system includes a plurality of lubrication passages 41 provided on the support arrangement 5 and fluidly connected to the receiving chamber 27. According to the embodiment shown on the figures, each lubrication passage 41 extends parallely with respect to the rotation axis A of the drive shaft 16.

Each lubrication passage 41 includes an oil inlet aperture 41.1 emerging in an inner surface of the support arrangement 5, and thus in the receiving chamber 27, and an oil outlet aperture 41.2 emerging in the bottom surface of a respective circular receiving hole 29 and particularly in a central portion of the bottom surface of the respective circular receiving hole 29.

According to the embodiment shown on the figures, each lubrication passage 41 has a cross section which is circular and which is higher than 25% of the cross section of the respective circular receiving hole 29. Advantageously, the cross section of each lubrication passage 41 is higher than the cross section of the respective eccentric hole 30.

The counterweight 26 is particularly configured to generate oil mist from oil contained in the oil reservoir 38 and to splash oil contained in the oil reservoir 38 towards inner walls of the receiving chamber 27 and towards the lubrication passages 41.

The lubrication system further includes an oil return passage 42 provided on the support arrangement 5 and configured to return a part of the oil, contained in the oil reservoir 38, towards the oil sump 50. According to the embodiment shown on the figures, the oil return passage 42 extends radially with respect to the rotation axis A of the drive shaft 16.

The oil return passage 42 includes an oil inlet port 42.1 emerging in an inner surface 39 of the support arrangement 5, and thus in the receiving chamber 27, and an oil outlet port 42.2 fluidly connected to the oil sump 50 and configured to return a part of the oil contained in the oil reservoir 38 towards the oil sump 50. Advantageously, the oil outlet port 42.2 is axially positioned so as to define the maximal oil level of the oil reservoir 38 and such that a lower end of the counterweight 26 is immersed into the oil reservoir 38. In other words, the oil outlet port 42.2 is located above the lower end of the counterweight 26.

According to the embodiment shown on the figures, the oil outlet port 42.2 emerges in a longitudinal oil channel 43 which extends along an outer surface of an annular cover 44 surrounding the electric driving motor 17, and which is fluidly connected to the oil sump 50.

Moreover, according to the embodiment shown on the figures, the lubrication system is also configured to lubricate at least partially the upper and lower main bearings 23, 24 and the orbiting scroll hub bearing 25 with oil supplied from the oil sump 50. Therefore, the lubrication system further includes:

a first lubrication hole 45 provided on the drive shaft 16 and fluidly connected to the oil supplying channel 34, the first lubrication hole 45 emerging in an outer wall of the upper guided portion 21 of the drive shaft 16 and facing the upper main bearing 23, and a second lubrication hole (not shown on the figures) provided on the drive shaft 16 and fluidly connected to the oil supplying channel 34, the second lubrication hole emerging in an outer wall of the lower guided portion 22 of the drive shaft 16 and facing the lower main bearing 24.

The lubrication system may further include a third lubrication hole provided on the drive shaft 16 and fluidly connected to the oil supplying channel 34, the third lubrication hole emerging in an outer wall of the driving portion 18 of the drive shaft 16 and facing the orbiting scroll hub bearing 25.

When the electric driving motor 17 is operated and the drive shaft 16 rotates about its rotation axis A, oil from the oil sump 50 climbs into the oil supplying channel 34 of the drive shaft 16 due to centrifugal effect, and reaches the end face 35 of the drive shaft 16 after lubricating the lower main bearing 24, the upper main bearing 23, and the orbiting scroll hub bearing 25. At least a part of the oil having reached the end face 35 of the drive shaft 16 is evacuated towards the oil supplying passage 37 via the oil feeding passage 36 provided on the driving portion 18. Another part of the oil having reached the top end of the drive shaft 16 may enter and lubricate the orbiting scroll hub bearing 25. Then, due to centrifugal effect, oil flows in the oil supplying passage 37 and is directed towards the thrust bearing surface 9 in order to lubricate at least partially the thrust bearing surface 9. Further to the oil originating from oil feeding passage 36, also oil leaving the lower end of orbiting scroll hub bearing 25 will enter the oil supplying passage 37 due to centrifugal effect.

In addition, at least a part of the oil having reached the end face 35 of the drive shaft 16 is evacuated towards the oil reservoir 38 and is collected in the oil reservoir 38. As the counterweight 26 is partially immersed in the oil reservoir 38, the rotation of the counterweight 26 generates oil mist from oil contained in the oil reservoir 38 and splashes oil contained in the oil reservoir 38 towards inner walls of the receiving chamber 27. Then the oil splashed on the inner walls of the receiving chamber 27 flows towards the lubrication passages 41 by centrifugal effect and enters the circular receiving holes 29.

Due to the relative large dimension of each lubrication passage 41, an important amount of oil reaches the bottom surface of each of the circular receiving holes 29. The rotational movement of the orbital discs 28 within the circular receiving holes 29 and of the pins 33 within the eccentric holes 30 ensures fast distribution and spreading of the oil entering the circular receiving holes 29 towards the inner and outer circumferential bearing surfaces 31, 32 by centrifugal effect, and thus an improved lubrication of the inner and outer circumferential bearing surfaces 31, 32.

After lubricating the inner and outer circumferential bearing surfaces 31, 32 and the thrust bearing surface 9, oil is returned towards the oil reservoir 38 and then towards the oil sump 50 via the oil return passage 42 and the longitudinal oil channel 43.

Of course, the invention is not restricted to the embodiment described above by way of non-limiting example, but on the contrary it encompasses all embodiments thereof.

What is claimed is:

1. A scroll compressor including:

a fixed scroll comprising a fixed base plate and a fixed spiral wrap, an orbiting scroll including an orbiting base plate and an orbiting spiral wrap, the fixed spiral wrap and the orbiting spiral wrap forming a plurality of compression chambers, a drive shaft including a driving portion configured to drive the orbiting scroll in an orbital movement, the drive shaft being rotatable around a rotation axis, a support arrangement including a thrust bearing surface on which is slidably mounted the orbiting scroll, the support arrangement and the orbiting scroll forming a receiving chamber in which the driving portion of the drive shaft is movably disposed, a rotation preventing device configured to prevent rotation of the orbiting scroll with respect to the fixed scroll and the support arrangement, the rotation preventing device including:

a plurality of orbital discs respectively arranged in circular receiving holes provided on the support arrangement, each orbital disc being provided with an eccentric hole and with an outer circumferential bearing surface configured to cooperate with an inner circumferential bearing surface provided on the respective circular receiving hole, and a plurality of pins each including a first end portion secured to the orbiting base plate and a second end portion rotatably mounted in the eccentric hole of a respective orbital disc, an oil sump, and a lubrication system configured to lubricate at least partially the inner and outer circumferential bearing surfaces with oil supplied from the oil sump, the lubrication system including an oil reservoir which is defined by the receiving chamber and in which part of the oil supplied to the lubrication system is collected and stored during operation of the scroll compressor, the lubrication system further including a plurality of lubrication passages provided on the support arrangement and fluidly connected to the receiving chamber, each lubrication passage including an oil outlet aperture emerging in a bottom surface of a respective circular receiving hole and an oil inlet aperture emerging in the receiving chamber.

2. The scroll compressor according to claim 1, wherein the lubrication system further includes an oil supplying channel fluidly connected to the oil sump and extending over at least a part of the length of the drive shaft, the oil supplying channel being configured to supply the oil reservoir with oil from the oil sump.

3. The scroll compressor according to claim 2, wherein the orbiting scroll further includes a hub portion in which the driving portion of the drive shaft is at least partially mounted, the hub portion being movably disposed in the receiving chamber.

4. The scroll compressor according to claim 2, further including a counterweight connected to the driving portion and configured to at least partially balance the mass of the orbiting scroll, the counterweight being movably disposed in the receiving chamber and being configured to generate oil mist from oil contained in the oil reservoir and to splash oil towards inner walls of the receiving chamber and towards the lubrication passages.

5. The scroll compressor according to claim 2, wherein each lubrication passage extends substantially parallely to the rotation axis of the drive shaft.

6. The scroll compressor according to claim 1, wherein the orbiting scroll further includes a hub portion in which the driving portion of the drive shaft is at least partially mounted, the hub portion being movably disposed in the receiving chamber.

7. The scroll compressor according to claim 6, wherein the counterweight includes a counterweight inner surface and a counterweight end surface respectively facing the hub portion and the orbiting base plate, the counterweight inner surface and the counterweight end surface at least partially defining the at least one oil supplying passage.

8. The scroll compressor according to claim 6, further including a counterweight connected to the driving portion and configured to at least partially balance the mass of the orbiting scroll, the counterweight being movably disposed in the receiving chamber and being configured to generate oil mist from oil contained in the oil reservoir and to splash oil towards inner walls of the receiving chamber and towards the lubrication passages.

9. The scroll compressor according to of claim 1, further including a counterweight connected to the driving portion and configured to at least partially balance the mass of the orbiting scroll, the counterweight being movably disposed in the receiving chamber and being configured to generate oil mist from oil contained in the oil reservoir and to splash oil towards inner walls of the receiving chamber and towards the lubrication passages.

10. The scroll compressor according to claim 9, wherein the lubrication system further includes at least one oil supplying passage at least partially defined by the counterweight, the at least one oil supplying passage being configured to supply the thrust bearing surface with oil.

11. The scroll compressor according to claim 10, wherein the lubrication system includes an oil feeding passage provided on the driving portion of the drive shaft and fluidly connected to the oil supplying channel, the oil feeding passage being configured to supply the at least one supplying passage with oil.

12. The scroll compressor according to claim 10, wherein the counterweight includes a counterweight inner surface and a counterweight end surface respectively facing the hub portion and the orbiting base plate, the counterweight inner surface and the counterweight end surface at least partially defining the at least one oil supplying passage.

13. The scroll compressor according to claim 1, wherein each lubrication passage extends substantially parallely to the rotation axis of the drive shaft.

14. The scroll compressor according to claim 1, wherein the lubrication system further includes an oil return passage provided on the support arrangement, the oil return passage including an oil inlet port emerging in the receiving chamber, and an oil outlet port fluidly connected to the oil sump and configured to return a part of the oil contained in the oil reservoir towards the oil sump.

15. The scroll compressor according to claim 6, wherein the oil outlet port is axially positioned so as to define a maximal oil level of the oil reservoir.

16. The scroll compressor according to claim 15, wherein the oil outlet port is axially positioned such that a lower end of the counterweight is immersed into the oil reservoir.

17. The scroll compressor according to claim 1, wherein the support arrangement further includes a main bearing configured to guide in rotation a guided portion of the drive shaft, the lubrication system being configured to lubricate at least partially the main bearing with oil supplied from the oil sump.

18. The scroll compressor according to claim 1, wherein each lubrication passage has a cross section which is higher than 25% of the cross section of the respective circular receiving hole.

19. The scroll compressor according to claim 1, wherein the oil outlet aperture of each lubrication passage emerges in a central portion of the bottom surface of the respective circular receiving hole.

20. A method for lubricating a rotation preventing device of a scroll compressor, comprising:

providing a scroll compressor according to claim 10, supplying oil to the oil reservoir defined by the receiving chamber, and delivering the oil to the lubrication passages with the help of the counterweight, and supplying oil to the thrust bearing surface via the at least one oil supplying passage which is at least partially defined by the counterweight.

* * * * *